US005910790A

United States Patent [19]

Ohmuro et al.

[11] Patent Number: 5,910,790

[45] **Date of Patent: *Jun. 8, 1999**

[54] BROAD CONICAL-MODE HELICAL ANTENNA

[75] Inventors: Norihiko Ohmuro; Akio Kuramoto; Kosuke Tanabe, all of Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,671

[22] Filed: Dec. 19, 1996

Related U.S. Application Data

[63] Continuation of application No. 08/363,914, Dec. 27, 1994, abandoned.

[30] Foreign Application Priority Data

| | | | |
|---|---|---|---|
| Dec. 28, 1993 | [JP] | Japan | 5-334808 |
| Dec. 28, 1993 | [JP] | Japan | 5-334809 |
| Dec. 28, 1993 | [JP] | Japan | 5-334810 |

[51] Int. Cl.[6] ..... H01Q 1/36

[52] U.S. Cl. ..... 343/895

[58] Field of Search ..... 343/895, 830; H01Q 1/36

[56] References Cited

U.S. PATENT DOCUMENTS

| | | | |
|---|---|---|---|
| 2,850,732 | 9/1958 | Kandoian et al. | 343/895 |
| 2,985,878 | 5/1961 | Krause et al. | 343/895 |
| 3,184,747 | 5/1965 | Kach | 343/895 X |
| 3,235,871 | 2/1966 | Smith, Jr. et al. | 343/895 |
| 3,906,509 | 9/1975 | DuHamel | 343/895 |
| 3,988,737 | 10/1976 | Middlemark | 343/895 X |
| 4,008,479 | 2/1977 | Smith | 343/895 |
| 4,097,867 | 6/1978 | Eroncig | 343/895 X |
| 4,163,981 | 8/1979 | Wilson | 343/895 X |
| 4,169,267 | 9/1979 | Wong et al. | 343/895 |
| 4,494,117 | 1/1985 | Coleman | 343/895 X |
| 5,146,235 | 9/1992 | Frese | 343/895 |
| 5,191,352 | 3/1993 | Branson | 343/895 |
| 5,329,287 | 7/1994 | Strickland | 343/895 X |

FOREIGN PATENT DOCUMENTS

| | | | |
|---|---|---|---|
| 51-126024 | 11/1976 | Japan . | |
| 2-60307 | 2/1990 | Japan | H01Q 11/08 |
| 2-35514 | 3/1990 | Japan . | |
| 2-133604 | 4/1990 | Japan . | |
| 2-84412 | 6/1990 | Japan . | |
| 273849 | 2/1977 | U.S.S.R. . | |

OTHER PUBLICATIONS

Hall et al, The ARRL Antenna Book, The American Radio Relay League, Inc., pp. 12–9–12, 1983.

J. L. Wong et al., "Broadband Quasi–Taper Helica Antennas", *IEEE Transactions on Antennas and Propagation,* vol. AP–27, No. 1, Jan. 1979, pp. 72–78.

H. Nakano et al., "Frequency characteristics of tapered backfire helical antenna with loaded termination", *IEE Proceedings,* vol. 131, Pt. H, No. 3, Jun. 1984, pp. 147–152.

Noriyoshi Terada et al., "Conical Beam Bifilar Helical Antenna for Mobile Satellite Communications", *IEICE Trans. on Antenna & Propagation,* A •P91–38, pp. 19–24, 1991.

*Primary Examiner*—Don Wong
*Assistant Examiner*—Tho Phan
*Attorney, Agent, or Firm*—Sughrue, Mion, Zinn, Macpeak & Seas, PLLC

[57] ABSTRACT

In a helical antenna where a helical conductor is spirally wound on a coaxial cable, spacings between turns of the helical conductor are changed in accordance with the positions of the turns.

31 Claims, 20 Drawing Sheets f / fo=0.965 f / fo = 1.035 f = 2660MHz f = 2690MHz f = 2660 MHz f = 2690MHz

---- 10 TURNS

—— 11 TURNS

BROAD CONICAL-MODE HELICAL ANTENNA

This is a continuation of application Ser. No. 08/363,914 filed Dec. 27, 1994 now abandoned.

BACKGROUND OF THE INVENTION

1. Field of the Invention

The present invention relates to a conical-mode helical antenna for use in a mobile station of a mobile satellite communication system, for example.

2. Description of the Related Art

In a mobile satellite communication system, uniform antennas in the azimuth direction have been used in mobile stations, since the uniform antennas in the azimuth direction do not need a tracking system for a satellite. Particularly, conical-mode helical antennas have directivity in the elevation direction, and therefore, the radiation directivity of these antennas can be toward the satellite, so that the gain can be increased.

A prior art conical-beam helical antenna has a coaxial cable and a helical conductor wound on the coaxial cable. In this case, the turns of the helical conductor are uniform along the coaxial cable, i.e., a spacing between the turns is definite along the coaxial cable. This will be explained later in detail.

In the above-mentioned prior art conical-mode helical antenna, however, since a radiation pattern is determined unambiguously by a spacing between turns, a diameter of the turns and the like, the radiation pattern is very narrow. In addition, the direction of the maximum beam of the radiation pattern is dependent upon the frequency of radio waves, and therefore, the gain at a particular elevation angle such as a satellite angle fluctuates. Thus, it is impossible to cover a broad elevation angle range.

SUMMARY OF THE INVENTION

It is an object of the present invention to provide a broad conical-mode helical antenna which can reduce the fluctuation of the gain at a particular elevation angle, thus covering a broad elevation angle range.

According to the present invention, in a helical antenna where a helical conductor is spirally wound on a coaxial cable, spacings between turns of the helical conductor are changed in accordance with the positions of the turns.

Also, in a helical antenna, a width of the helical conductor is changed in accordance with positions of turns of the helical conductor.

Further, in a helical antenna, a plurality of coaxial cables each having different lengths along one axis are provided, and a plurality of helical conductors, each spirally wound on one of the coaxial cables, are provided.

Furthermore, in a helical antenna, at least one helical conductor is mounted within a dielectric cylinder, and a coaxial cable is mounted outside of the dielectric cylinder and is connected to the helical conductor. Also, twisting caps mounted on the dielectric cylinder twist the helical conductor.

BRIEF DESCRIPTION OF THE DRAWINGS

The present invention will be more clearly understood from the description as set forth below, in comparison with the prior art, with reference to the accompanying drawings, wherein.

DESCRIPTION OF THE PREFERRED EMBODIMENTS

Before the description of the preferred embodiments, a prior art helical antenna will be explained with reference to FIGS. 1, 2A and 2B.

Figure 1:
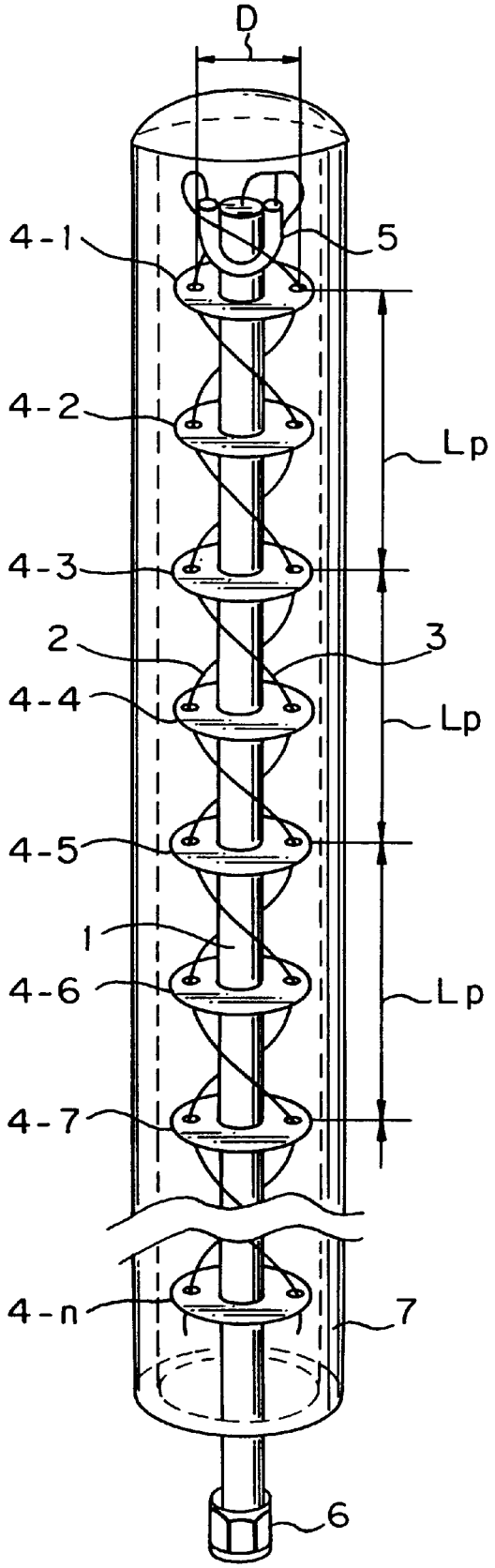
Fig. 1 PRIOR ART
FIG. 1 is a cut-away perspective view illustrating a prior art uniform conical-beam bifilar helical antenna.

In FIG. 1, which illustrates a prior art uniform conical-mode bifilar helical antenna, reference numeral 1 designates a coaxial cable on which two helical conductors 2 and 3 are spirally wound. In this case, the helical conductors 2 and 3 are fixed by dielectric supporting elements 4-1 through 4-n to the coaxial cable 1. That is, a spacing (pitch) between the dielectric supporting elements 4-1 through 4-n is definite ($=L_p/2$), and therefore, a spacing (pitch) between turns of the helical conductors 2 and 3 is also definite ($=L_p$). Further, a diameter of each turn of the helical conductors 2 and 3 is definite (=D).

Also, in FIG. 1, reference numeral 5 designates a U balanced-to-unbalanced line transformer (balun) connected to the helical conductors 2 and 3, 6 designates an input/output connector, and 7 designates a waterproof radome.

In the helical antenna of FIG. 1, when a high frequency power signal is supplied via the input/output connector 6 and the U balun 5 to the helical conductors 2 and 3, opposite phase currents flow through the helical conductors 2 and 3, respectively. As a result, the helical conductors 2 and 3 are excited to radiate a circular polarization of radio waves.

Figure 2A:
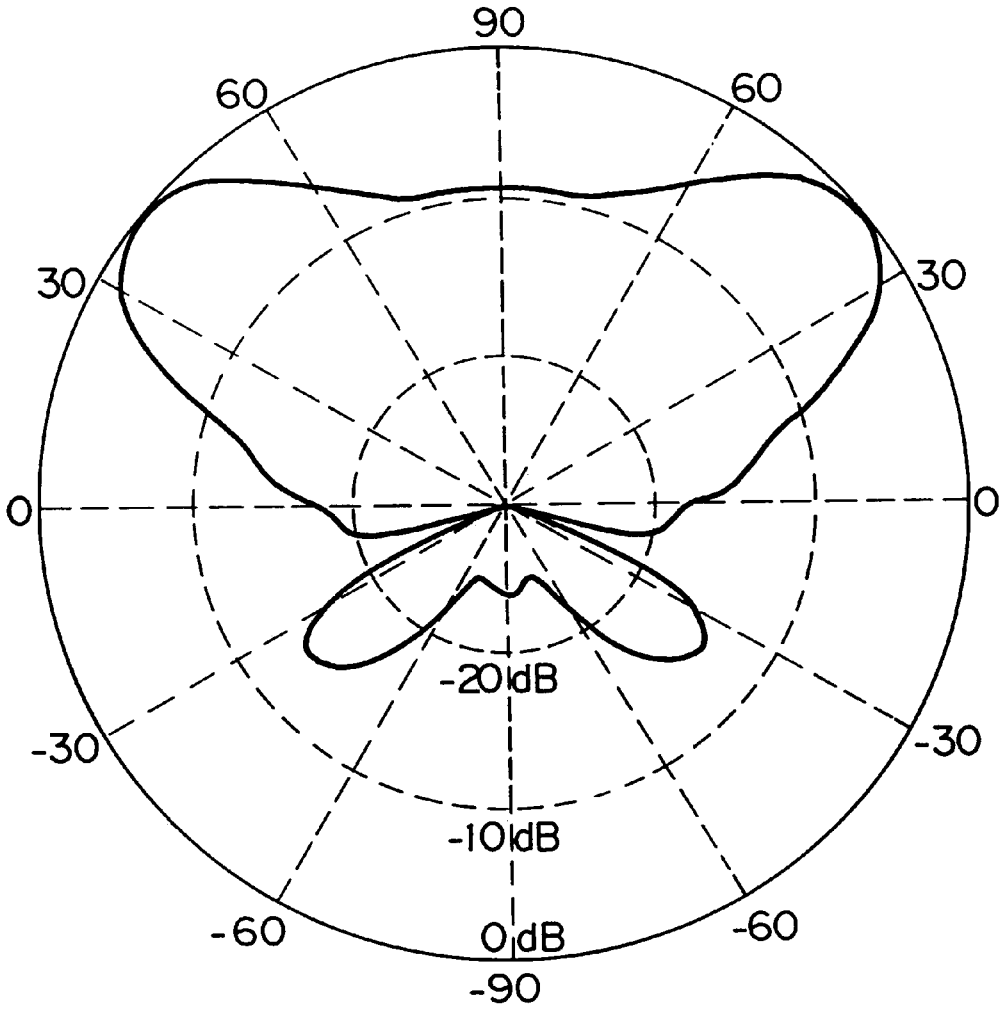
Fig. 2A PRIOR ART
FIG. 2A is a radiation pattern generated by the helical antenna of FIG. 1.
Figure 2B:
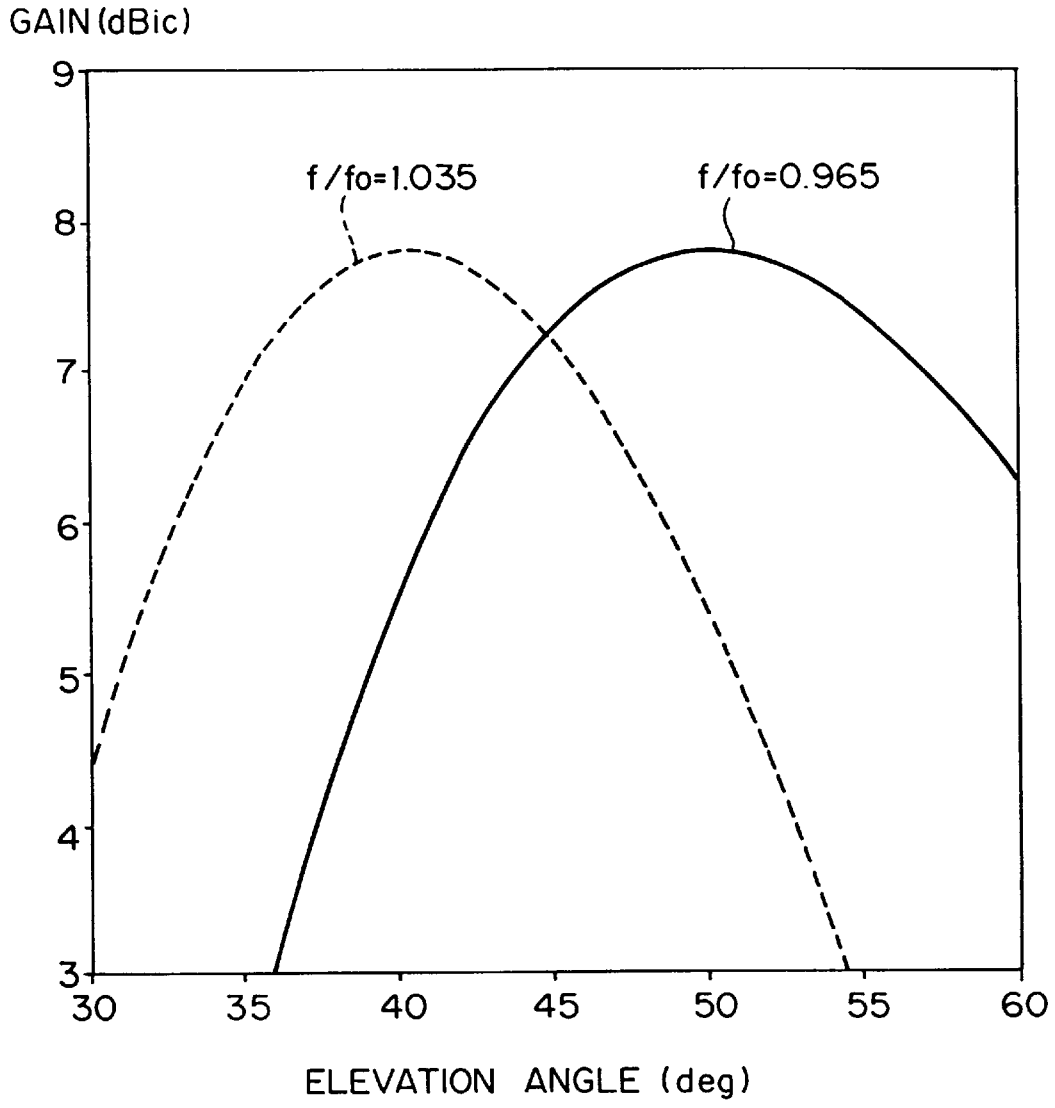
Fig. 2B PRIOR ART
FIG. 2B is a graph showing the frequency characteristics of the helical antenna of FIG. 1.

In the helical antenna of FIG. 1, however, the circular polarization of radio waves has a narrow radiation pattern as shown in FIG. 2A (see N. Terada et al. "Conical Beam Bifilar Helical Antenna for Mobile Satellite Communications", IEICE Trans. on Antenna & Propagation, A . P91-38, pp.19–24, 1991). In addition, as shown in FIG. 2B, the direction of the maximum beam is dependent upon the frequency of radio waves. In FIG. 2B, note that $f_o$ indicates a center frequency, and f indicates a used frequency. As a result, the gain at a particular elevation angle such as a satellite angle may be fluctuated, and accordingly, it is impossible to cover a broad elevation angle range. In FIG. 2A, note that the elevation angle range at a 7% specific gain is about 37° to 44°.

Figure 3:
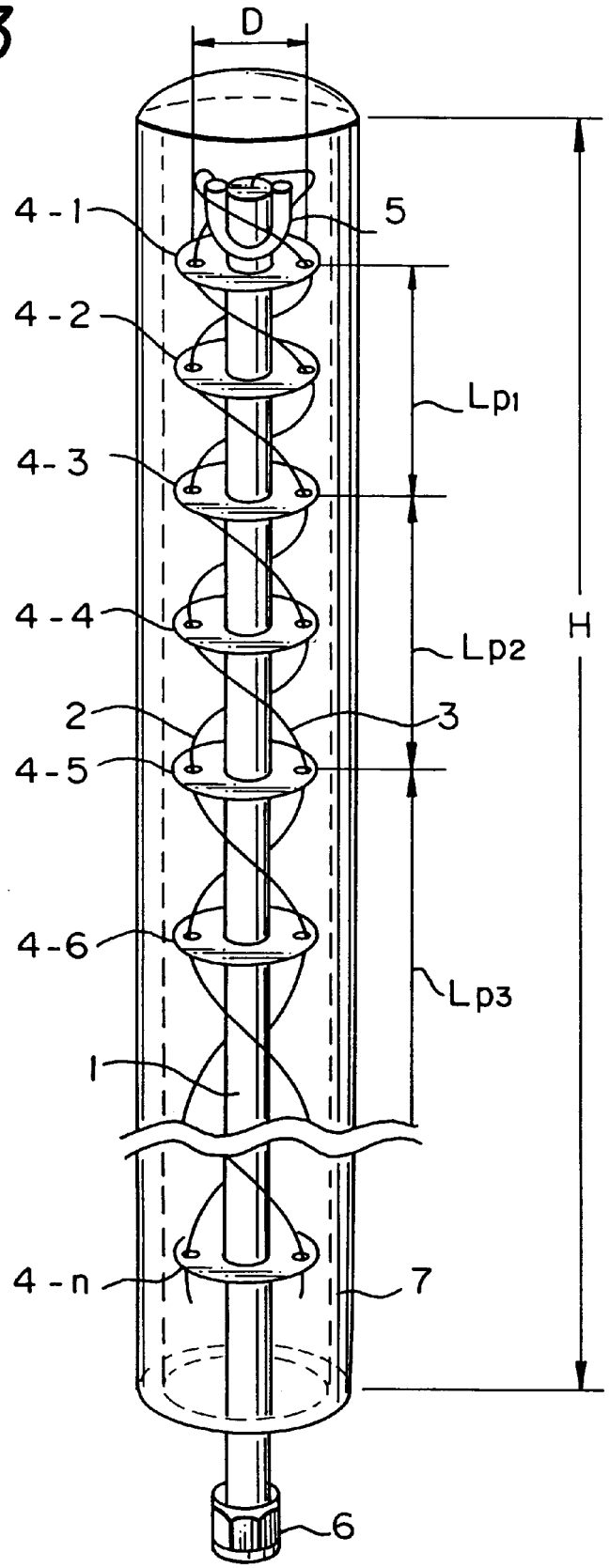
FIG. 3 is a cut-away perspective view illustrating a first embodiment of the nonuniform conical-beam bifilar helical antenna according to the present invention.

In FIG. 3, which illustrates a first embodiment of the present invention, the spacings between the turns of the helical conductors 2 and 3 are nonuniform along the coaxial cable 1. For example, the spacing $L_{pk}$ satisfies the following:

$$L_{pk}=L_{p,\,k-1}+\Delta L \tag{1}$$

where ΔL is a definite value;

k is 1, 2, . . . , or m−1; and m is a number of turns.

Also, in the helical antenna of FIG. 3, when a high frequency power signal is supplied via the input/output connector 6 and the U balun 5 to the helical conductors 2 and 3, opposite phase currents flow through the helical conductors 2 and 3, respectively. As a result, the helical conductors 2 and 3 are excited to radiate a circular polarization of radio waves. In this case, the elevation angle of a radiation beam generated from a lower portion of the conductors 2 and 3 is larger than that of a radiation beam generated from an upper portion of the conductors 2 and 3. As a result, the conical-beam generated from the helical antenna of FIG. 3 is broader than that generated from the helical antenna of FIG. 1.

For example, if H=460 mm, D=12 mm, and the number of turns =7, then, $$\Delta L = 6\,\text{mm}$$
$$L_{p1} = 48\,\text{mm}$$
$$L_{p2} = 54\,\text{mm}$$
$$\vdots$$
$$L_{p7} = 84\,\text{mm}$$

Figure 4A:
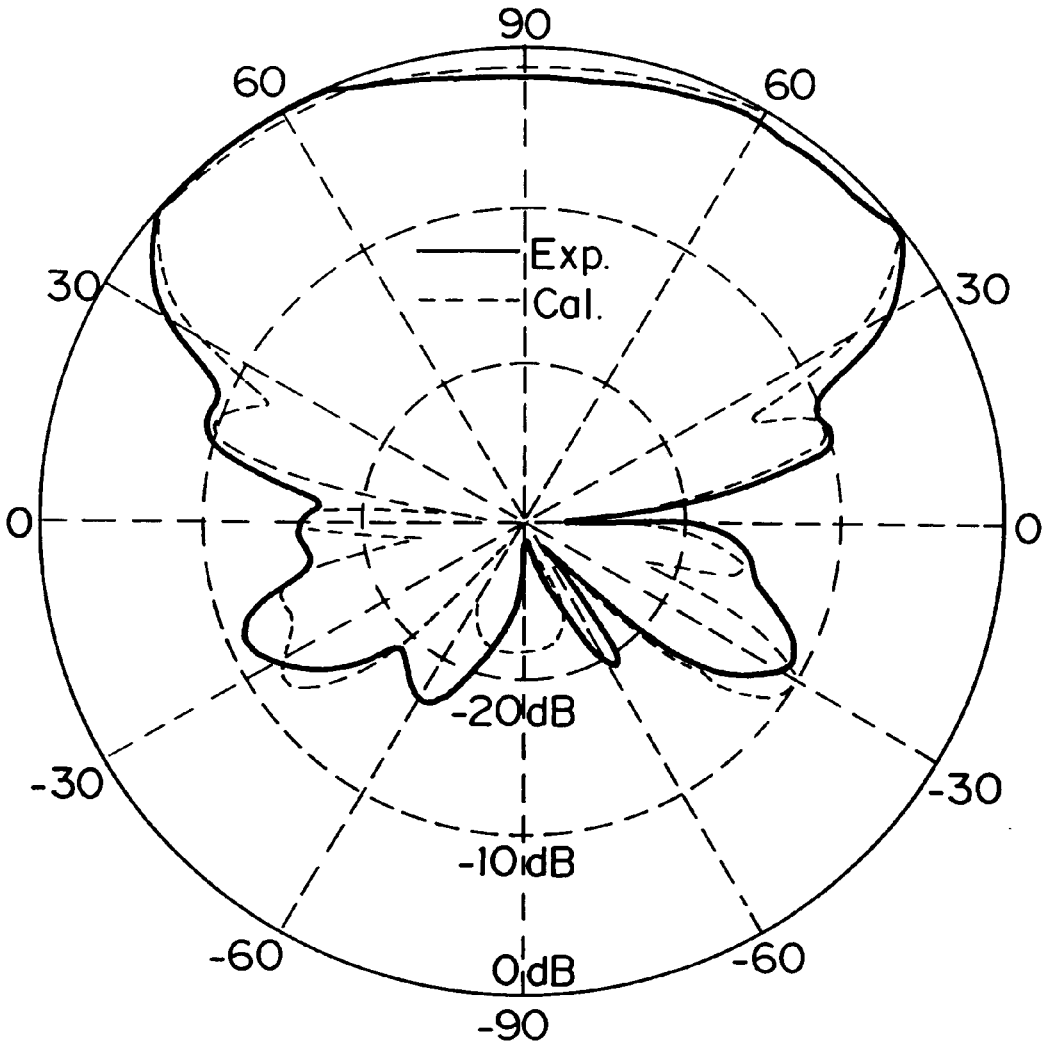
FIGS. 4A and 4B are radiation patterns generated by the helical antenna of FIG. 3.
Figure 4B:
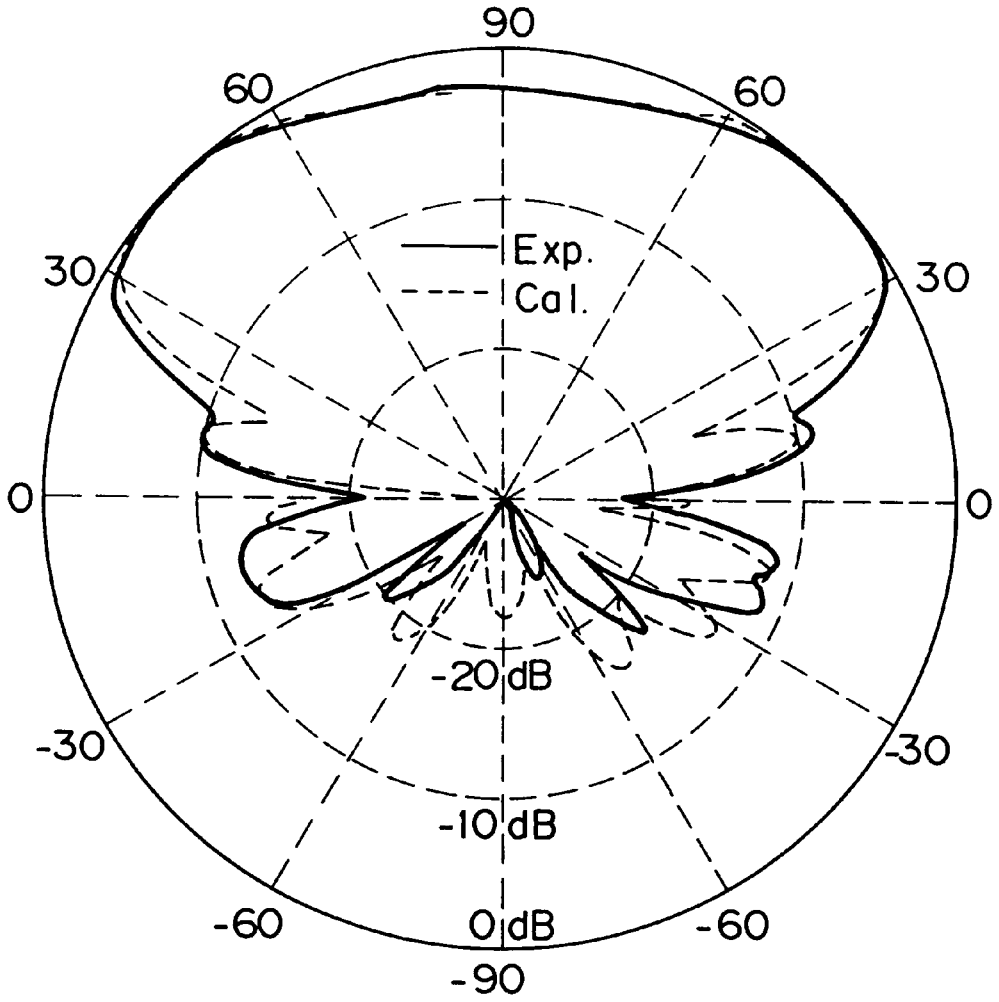
Figure 4C:
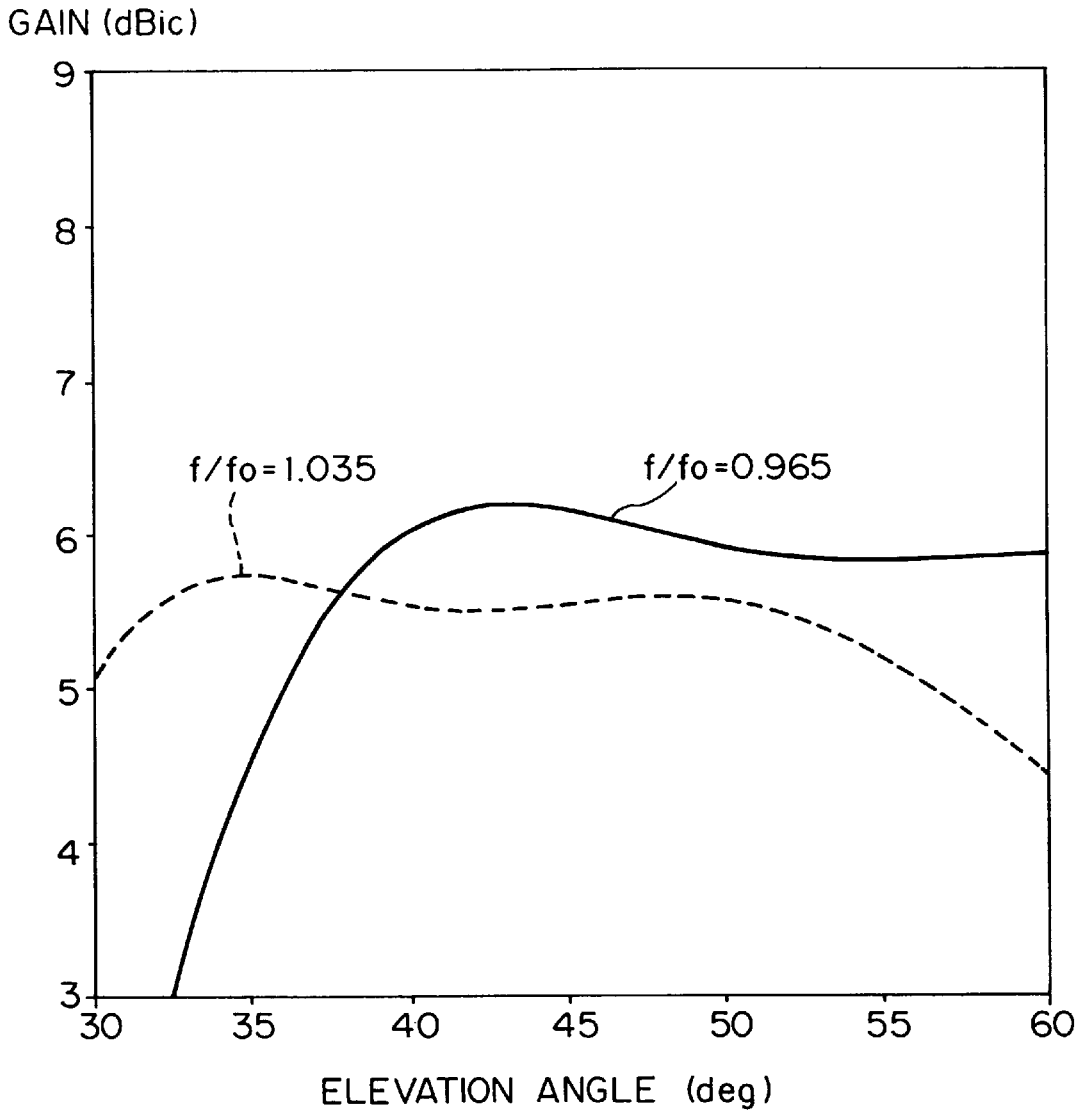
FIG. 4C is a graph showing the frequency characteristics of the helical antenna of FIG. 3.

In this case, a radiation pattern where $f/f_0=0.965$ is shown in FIG. 4A, and a radiation pattern where $f/f_o=1.035$ is shown in FIG. 4B. Also, a frequency characteristic is shown clearly in FIG. 4C. As can be seen in FIGS. 4A and 4B, the calculated values are substantially the same as the experimental values. That is, the elevation angle range at a 7% specific gain is about 37° to 53°.

In the helical antenna of FIG. 3, although the spacing between the turns is gradually increased from the upper side to the lower side, it is possible to gradually decrease the spacing between the turns as follows:

$$L_{pk}=L_{p,\,k-1}-\Delta L \tag{2}$$

Further, it is possible to gradually change the spacing between the turns nonequidistantly.

Figure 5:
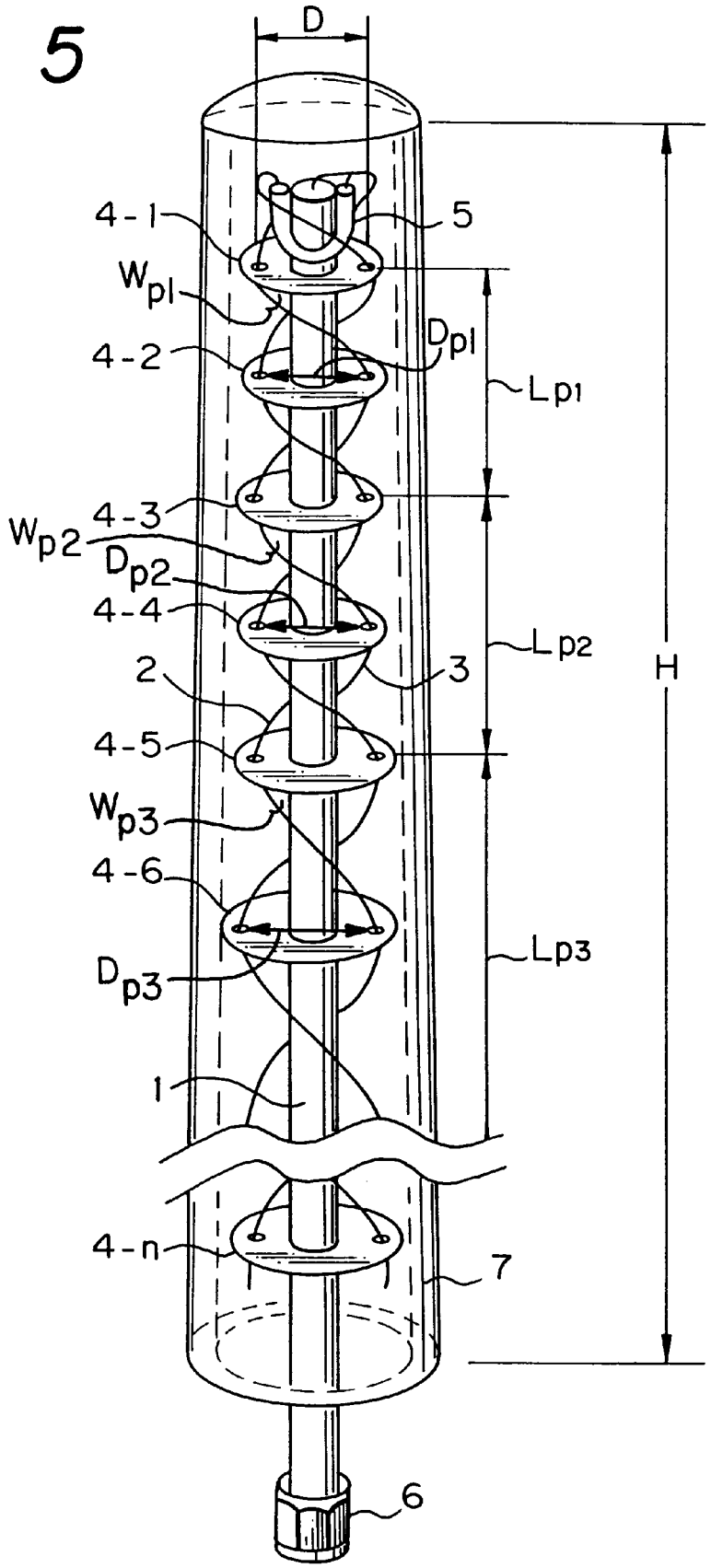
FIG. 5 is a cut-away perspective view illustrating a second embodiment of the nonuniform conical-beam bifilar helical antenna according to the present invention.

In FIG. 5, which illustrates a second embodiment of the present invention, a diameter of each turns of the helical conductors 2 and 3 is nonuniform along the coaxial cable 1. For example, the diameter $D_{pk}$ satisfies the following $$D_{pk}=D_{p,\,k-1}+D \tag{3}$$

where ΔD is a definite value;

k is 1, 2, . . . , or m−1; and m is a number of turns.

Also, in the helical antenna of FIG. 5, when a high frequency power signal is supplied via the input/output connector 6 and the U balun 5 to the helical conductors 2 and 3, opposite phase currents flow through the helical conductors 2 and 3, respectively. As a result, the helical conductors 2 and 3 are excited to radiate a circular polarization of radio waves. Also, in this case, the elevation angle of a radiation beam generated from a lower portion of the conductors 2 and 3 is larger than that of a radiation beam generated from an upper portion of the conductors 2 and 3. As a result, the conical-beam generated from the helical antenna of FIG. 5 is broader than that generated from the helical antenna of FIG. 1.

In the helical antenna of FIG. 5, although the diameter of the turns is gradually increased from the upper side to the lower side, it is possible to gradually decrease the diameter of the turns as follows:

$$D_{pk}=D_{p,\,k-1}\Delta D \tag{4}$$

Further, a width of the helical conductors 2 and 3 is nonuniform along the coaxial cable 1, for example, in FIG. 5 $W_{p1}\neq W_{p2}\neq W_{p3}$. For example, the width $W_{pk}$ satisfies the following:

$$W_{pk}=W_{p,\,k-1}+\Delta W \tag{5}$$

where ΔW is a definite value;

k is 1, 2, . . . , or m−1; and m is a number of turns.

Otherwise, the following is satisfied:

$$W_{pk}=W_{p,\,k-1}-\Delta W \tag{6}$$

Further, it is possible to gradually change the width of the helical conductors 2 and 3 nonequidistantly.

Figure 6:
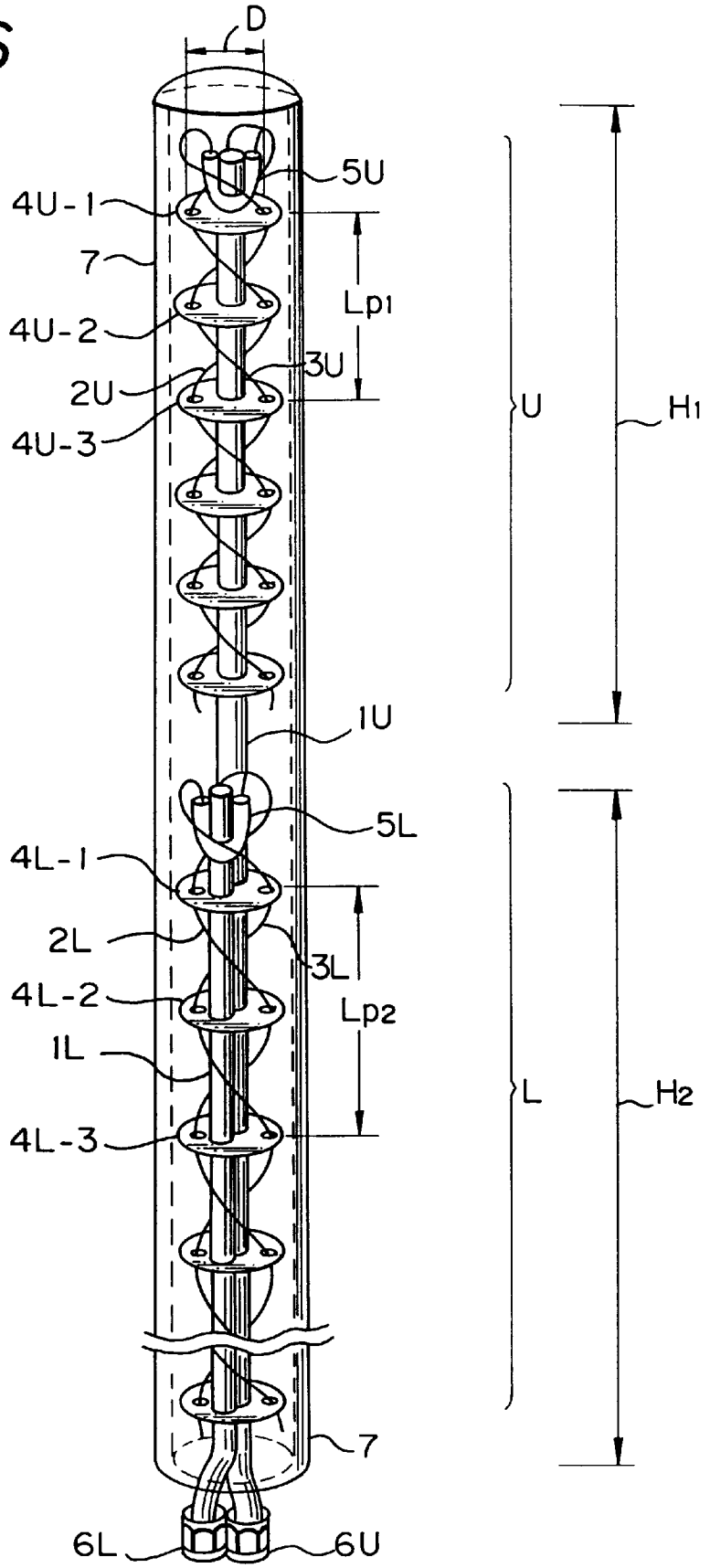
FIG. 6 is a cut-away perspective view illustrating a third embodiment of the uniform conical-beam bifilar helical antenna according to the present invention.

In FIG. 6, which illustrates a third embodiment of the present invention, a coaxial cable 1U and a coaxial cable 1L shorter than the coaxial cable 1U are provided adjacently along one axis. In this case, the bottom face of the coaxial cable 1U coincides with that of the coaxial cable 1L.

Two helical conductors 2U and 3U are spirally wound on an upper portion U of the coaxial cable 1U. In this case, the helical conductors 2U and 3U are fixed by dielectric supporting elements 4U-1, 4U-2, . . . which have a definite spacing $L_{p1}$ therebetween. For example, the parameters of the conductors 2U and 3U are as follows:

D (diameter of turns)=12 mm $L_{p1}$=60.5 mm (Pitch angle=58.1°)

Number of turns=6

H1 (height)=363.2 mm

Also, two helical conductors 2L and 3L are spirally wound on the coaxial cable 1L, i.e., an upper portion U of the coaxial cable 1U. In this case, the helical conductors 2L and 3L are fixed by dielectric supporting elements 4L-1, 4L-2, . . . which have a definite spacing $L_{p^2}$ therebetween. For example, the parameters of the conductors 2L and 3L are as follows:

D (diameter of turns)=12 mm $L_{p^1}$=53.6 mm (Pitch angle=54.9°)

Number of turns=6

H2 (height)=321.7 mm

The helical conductors 2U and 3U are connected via a U balun 5U to the coaxial cable 1U which is connected to an input/output connector 6U. Similarly, the helical conductors 2L and 3L are connected via a U balun 5L to the coaxial cable 1L which is connected to an input/output connector 6L.

The radome 7 is commonly provided for the coaxial cables 1U and 1L.

Figure 7A:
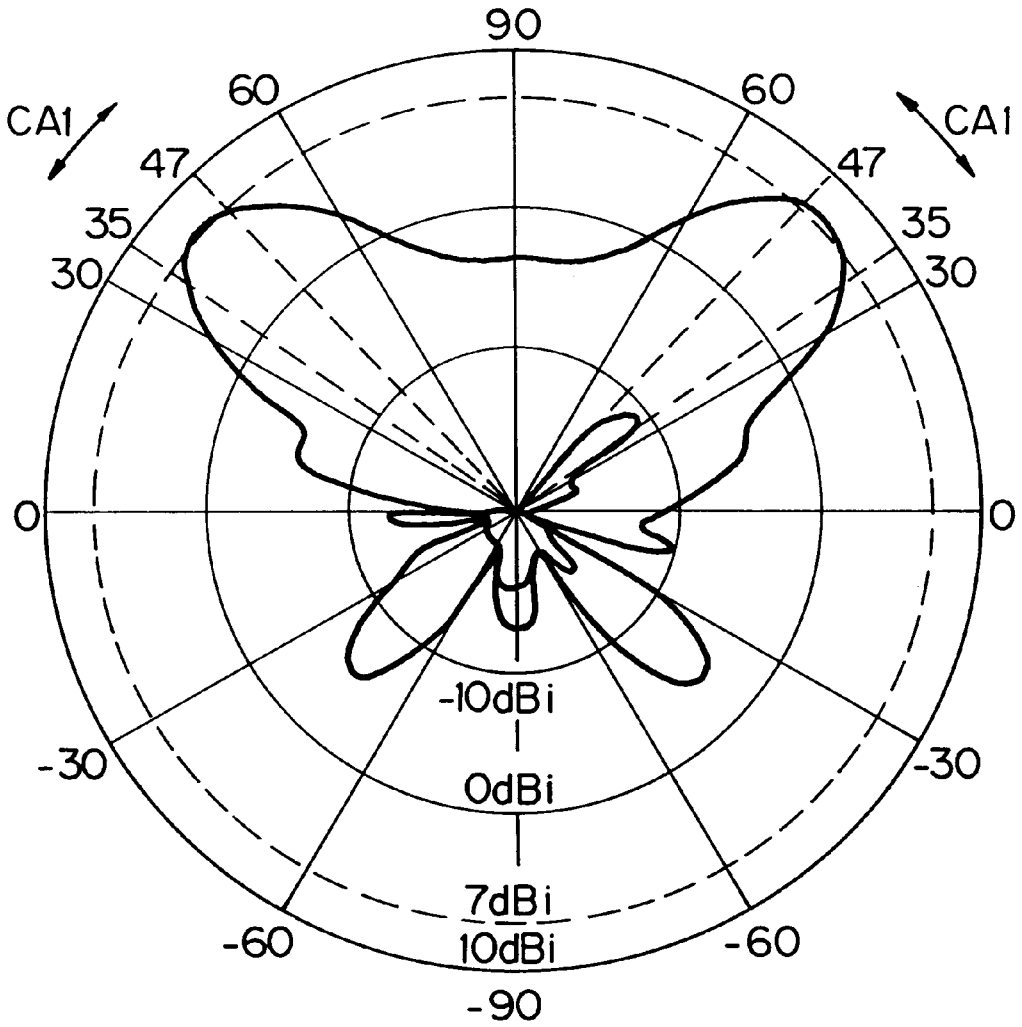
FIGS. 7A and 7B are radiation patterns generated by the upper portion of the helical antenna of FIG. 6.
Figure 7B:
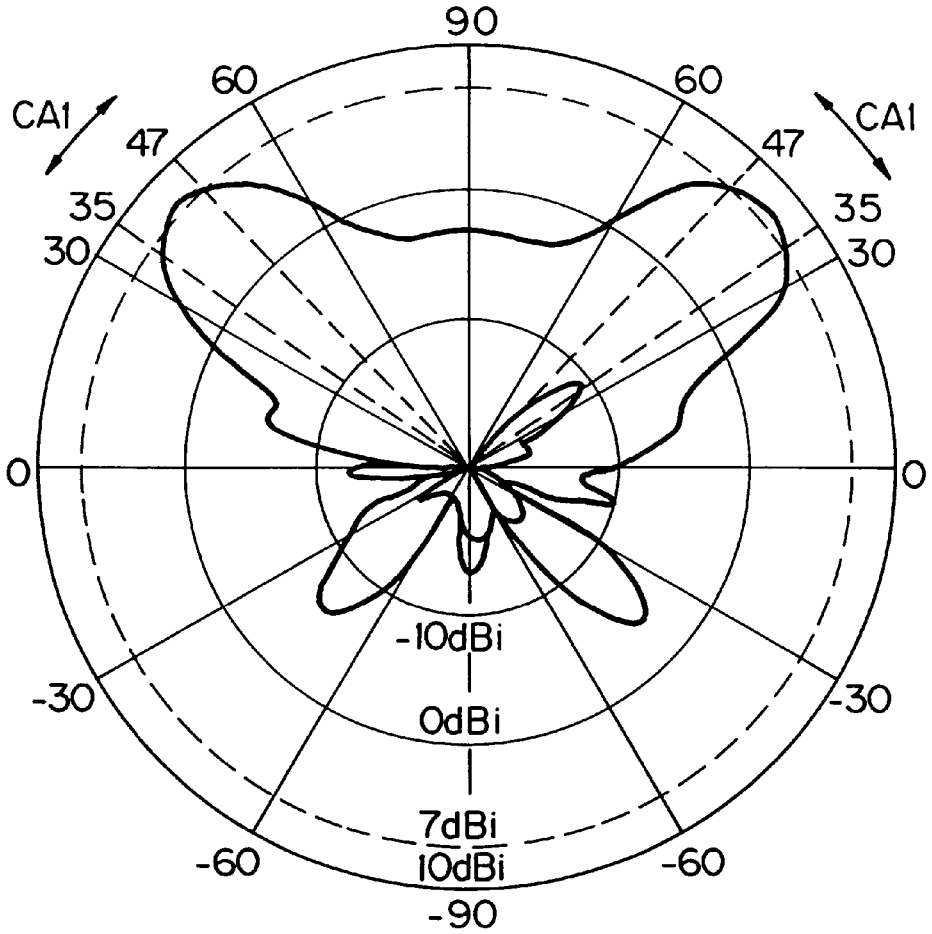
Figure 7C:
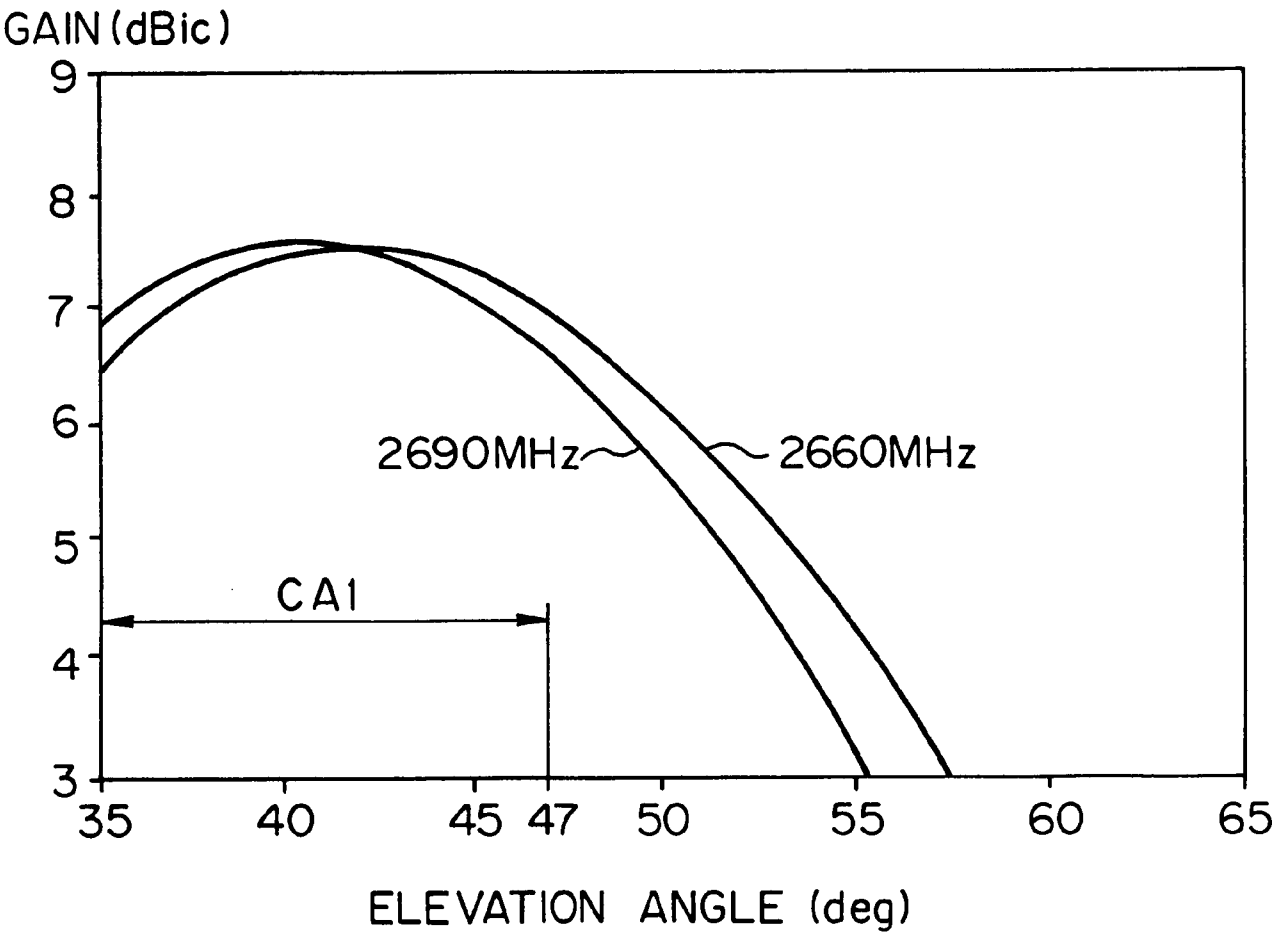
FIG. 7C is a graph showing the frequency characteristics of the upper portion of helical antenna of FIG. 6.

A coverage area CA1 determined by the helical conductors 2U and 3U is explained next with reference to FIGS. 7A, 7B and 7C. That is, as shown in FIGS. 7A, 7B and 7C, the coverage area CA1 is an elevation angle range from 35° to 47° at a gain of about 6.4 dBic or more. Note that FIG. 7A shows a radiation pattern where a frequency of a transmitting (receiving) signal is 2660 MHz, FIG. 7B shows a radiation pattern where a frequency of a transmitting (receiving) signal is 2690 MHz, and FIG. 7C is a diagram of partial enlargements of FIG. 7A and 7B.

Figure 8A:
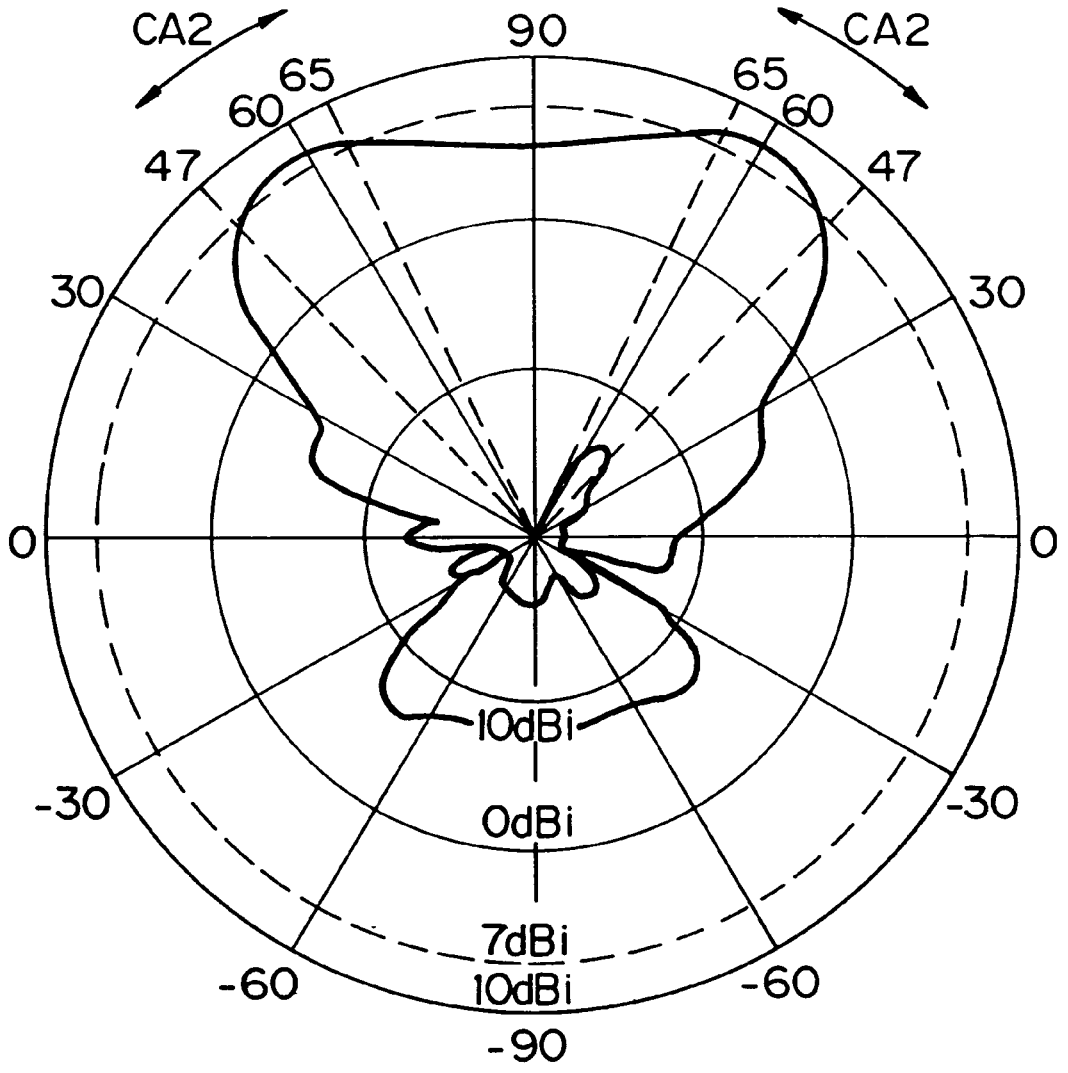
FIGS. 8A and 8B are radiation patterns generated by the lower portion of the helical antenna of FIG. 6.
Figure 8B:
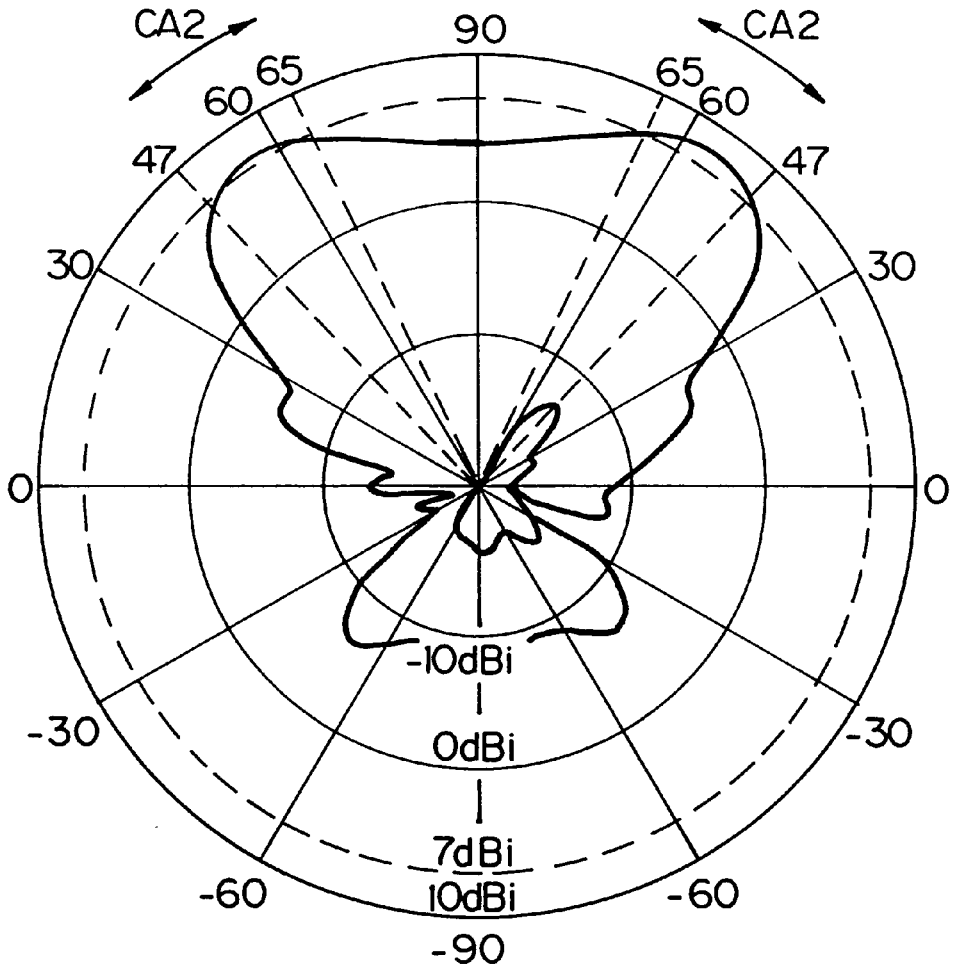
Figure 8C:
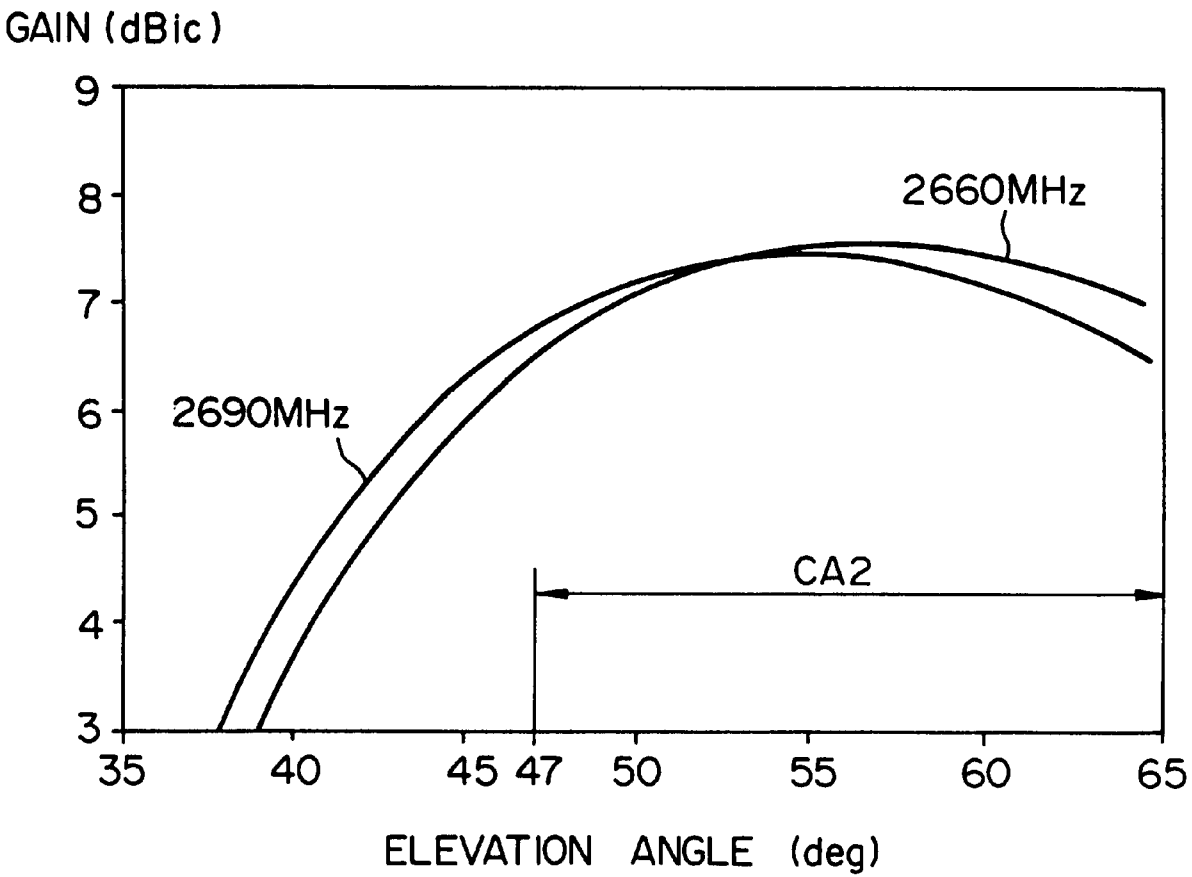
FIG. 8C is a graph showing the frequency characteristics of the lower portion of helical antenna of FIG. 6.

A coverage area CA2 determined by the helical conductors 2L and 3L is explained with reference to FIGS. 8A, 8B and 8C. That is, as shown in FIGS. 8A, 8B and 8C, the coverage area CA2 is an elevation angle range from 47° to 65° at a gain of about 6.4 dBic or more. Note that FIG. 8A shows a radiation pattern where a frequency of a transmitting (receiving) signal is 2660 MHz, FIG. 8B shows a radiation pattern where a frequency of a transmitting (receiving) signal is 2690 MHz, and FIG. 8C is a diagram of partial enlargements of FIG. 8A and 8B.

Thus, if all of the helical conductors 2U and 3U and the helical conductors 2L and 3L are individually excited, a broad coverage area combined by the coverage areas CA1 and CA2 can be obtained, i.e., an elevation angle range of 35° to 65° at a gain of about 6.4 dBic or more can be obtained. As occasion demands, one of the input/output connectors 6U and 6L is selected, thus switching from the coverage area A1 to the coverage area A2 or vice versa.

In the helical antenna of FIG. 6, it is possible to change the helix diameter of each turn of the helical conductors 2U and 3U in relation to that of the helical conductors 2L and 3L, instead of changing the spacing between the turns. Also, it is possible to change the width of the helical conductors 2U and 3U in relation to that of the helical conductors 2L and 3L, instead of changing the spacing between the turns.

Figure 9:
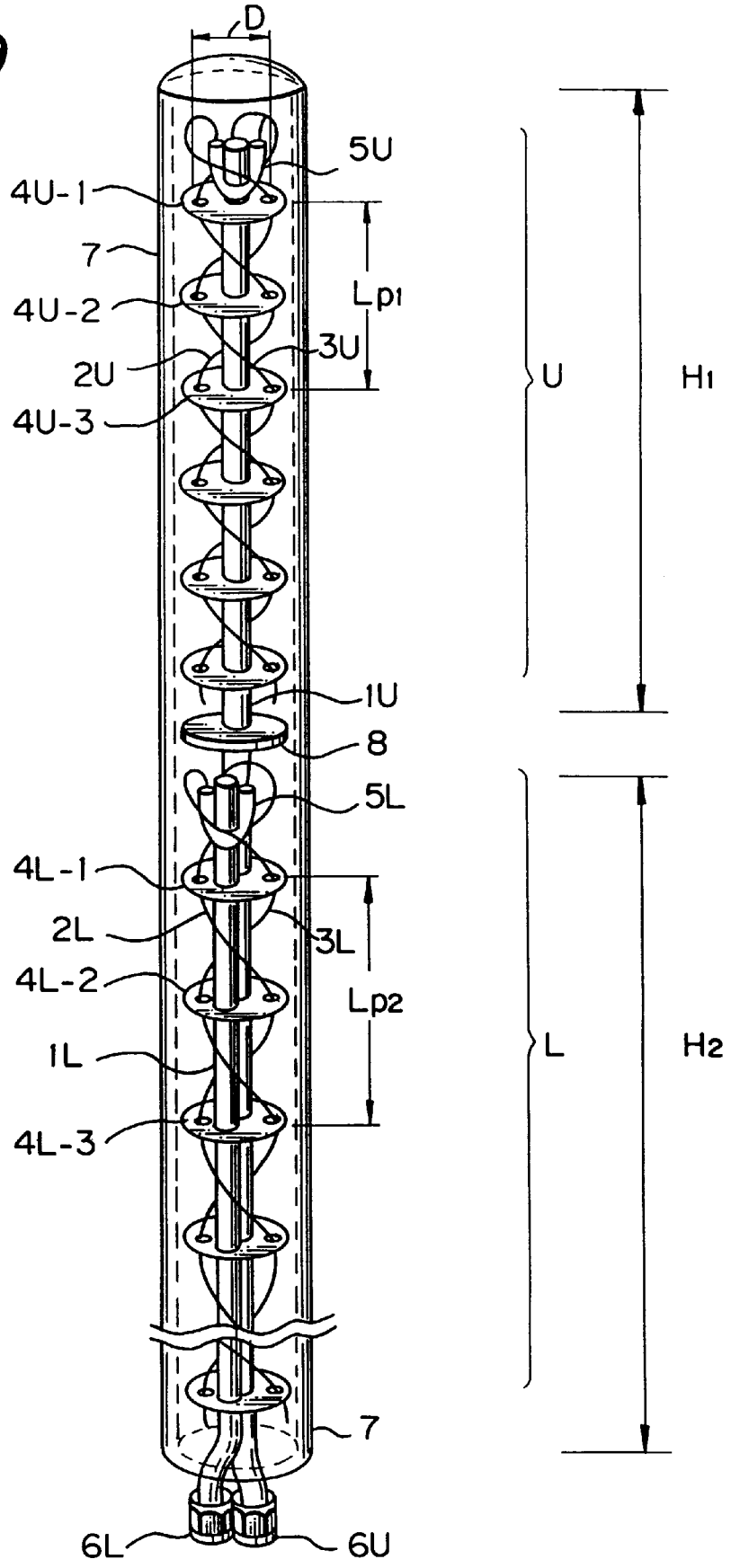
FIG. 9 is a cut-away perspective view illustrating a fourth embodiment of the nonuniform conical-beam bifilar helical antenna according to the present invention.

In FIG. 9, which illustrates a fourth embodiment of the present invention, a metal plate 8 is inserted into the coaxial cable 1U between the helical conductors 2U and 3U and the helical conductors 2L and 3L of FIG. 6. Thus, the helical conductors 2U and 3U are electrically shielded by the metal plate 8 from the helical conductors 2L and 3L, so that the mutual combination therebetween is weakened.

Figure 10:
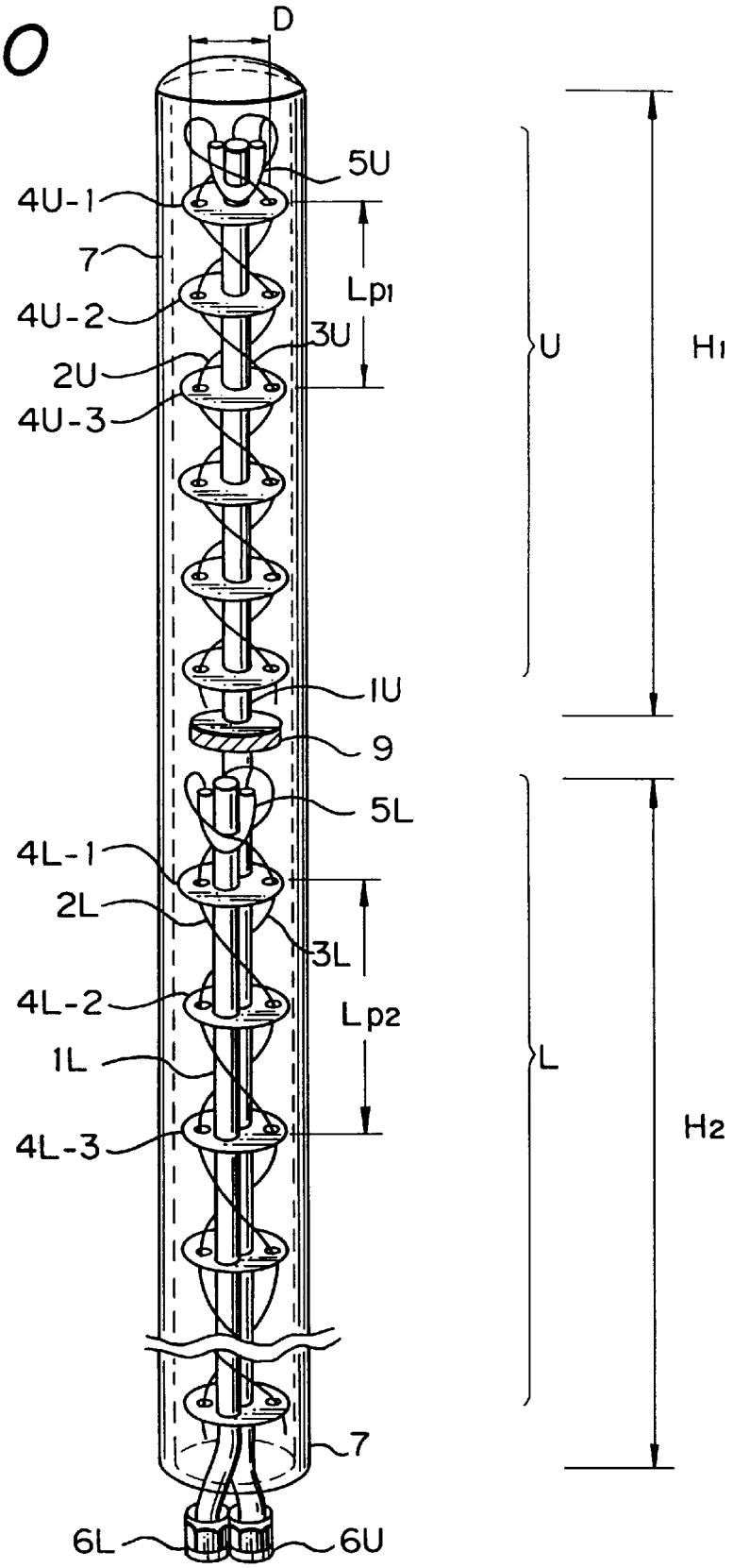
FIG. 10 is a cut-away perspective view illustrating a fifth embodiment of the nonuniform conical-beam bifilar helical antenna according to the present invention.

In FIG. 10, which illustrates a fifth embodiment of the present invention, a radio wave absorption plate 9 is inserted into the coaxial cable 1U between the helical conductors 2U and 3U and the helical conductors 2L and 3L of FIG. 6. Thus, in the same way as in the fourth embodiment, the helical conductors 2U and 3U are electrically shielded by the radio wave absorption plate 9 from the helical conductors 2L and 3L, so that the mutual combination therebetween is weakened.

In FIGS. 9 and 10, radio waves generated from the helical conductors 2U and 3U hardly affect the helical conductors 2L and 3L, and radio waves generated from the helical conductors 2L and 3L hardly affect the helical conductors 2U and 3U.

In FIGS. 6, 9 and 10, although two coaxial cables are provided, a plurality of coaxial cables each having different lengths can be provided.

Figure 11:
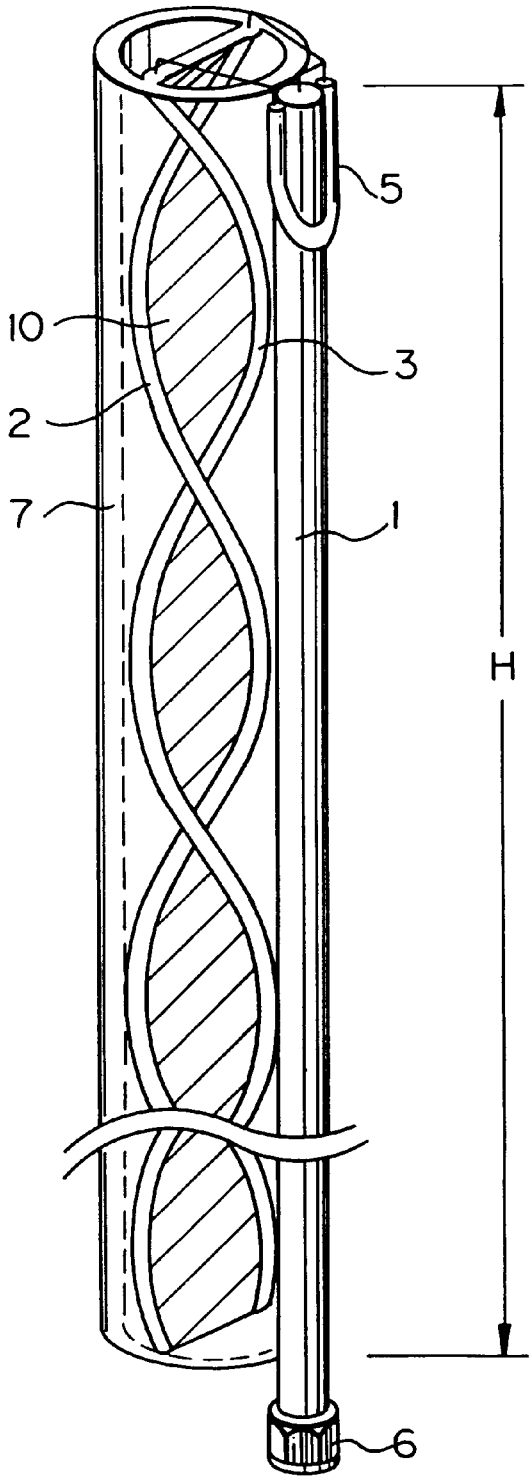
FIG. 11 is a cut-away perspective view illustrating a sixth embodiment of the uniform conical-beam bifilar helical antenna according to the present invention.

In FIG. 11, which illustrates a sixth embodiment of the present invention, the coaxial cable 1 is outside of the radome 7 which is made of cylindrical dielectric. The helical conductors 2 and 3 disposed within the radome 7 are supported by each other with a dielectric film 10 therebetween, to maintain a spacing between the helical conductors 2 and 3 at a definite value. In this case, the dielectric supporting members 4-1, 4-2, . . . of FIG. 1 is not provided.

Figure 12:
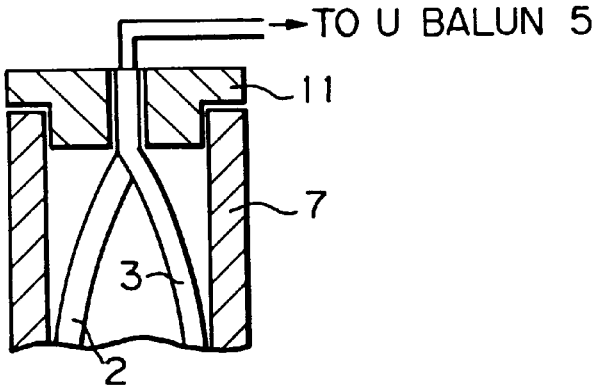
FIG. 12 is a cross-sectional view of the upper portion of the helical antenna of FIG. 11.

In FIG. 12, which illustrates the details of the upper portion of the helical antenna of FIG. 11, a cap 11 is fixed to an upper end of the radome 7. On the other hand, in FIG. 13, which illustrates the details of the lower portion of the helical antenna of FIG. 11, a cap 12 is rotatably mounted on a lower end of the radome 7. That is, the lower portion of the inside wall of the radome 7 has a plurality of recesses 7*a*, while the cap 12 has a plurality of protrusions 12*a* corresponding to the recesses 7*a*. Also, the cap 12 has recesses 12*b* and 12*c* for receiving the helical conductors 2 and 3. Thus, after the helical conductors 2 and 3 are twisted manually, the bottom ends of the helical conductors 2 and 3 are inserted into the recesses 12*b* and 12*c* of the cap 12, and the cap 12 is fitted into the bottom of the radome 7 by corresponding the protrusions 12*a* of the cap 12 to the recesses 7*a* of the cap 12. Thus, an arbitrary number of turns of the helical conductors 2 and 3 can be obtained.

Figure 13:
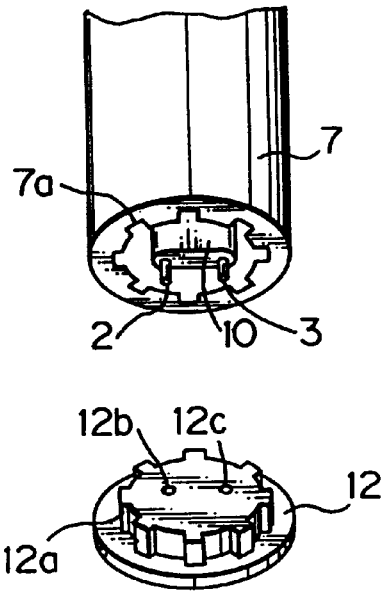
FIG. 13 is a perpective view of the lower portion of the helical antenna of FIG. 11.
Figure 14:
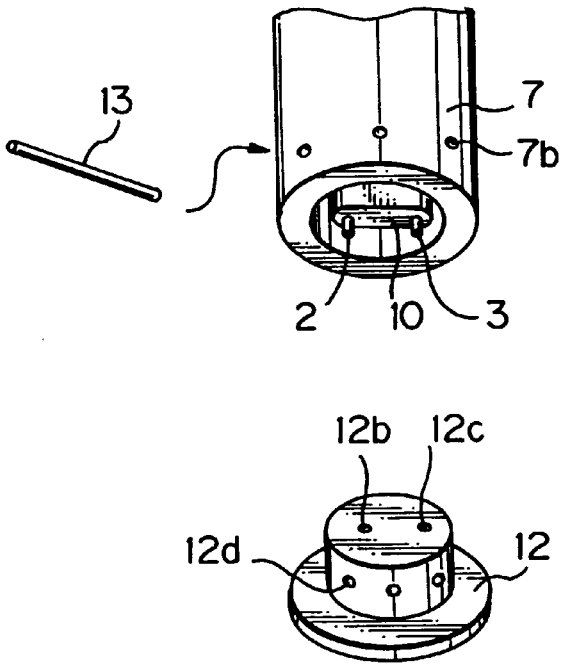
FIG. 14 is another perpective view of the lower portion of the helical antenna of FIG. 11.

In FIG. 14, which is a modification of the lower portion of the helical antenna of FIG. 13, a plurality of holes 7*b* are provided at the bottom of the radome 7 instead of the recesses 7*a* of FIG. 13. Also, a plurality of holes 12*d* corresponding to the holes 7*b* of the radome 7 are provided in the cap 12 instead of the protrusions 12*a* of FIG. 13. Thus, after the cap 12 is fitted to the bottom of the radome 7, so that the helical conductors 2 and 3 are inserted into the holes 12*b* and 12*c* of the cap 12, the cap 12 is twisted manually and the cap 12 is fixed to the radome 7 by inserting a pin 13 into one of the holes 7*b* and one of the holes 12*d*. Thus, an arbitrary number of turns of the helical conductors 2 and 3 can be obtained.

For example, the parameters of the helical conductors 2 and 3 are as follows:

H (height)=700 mm

Spacing between the conductors 2 and 3=8.5 mm

Figure 15:
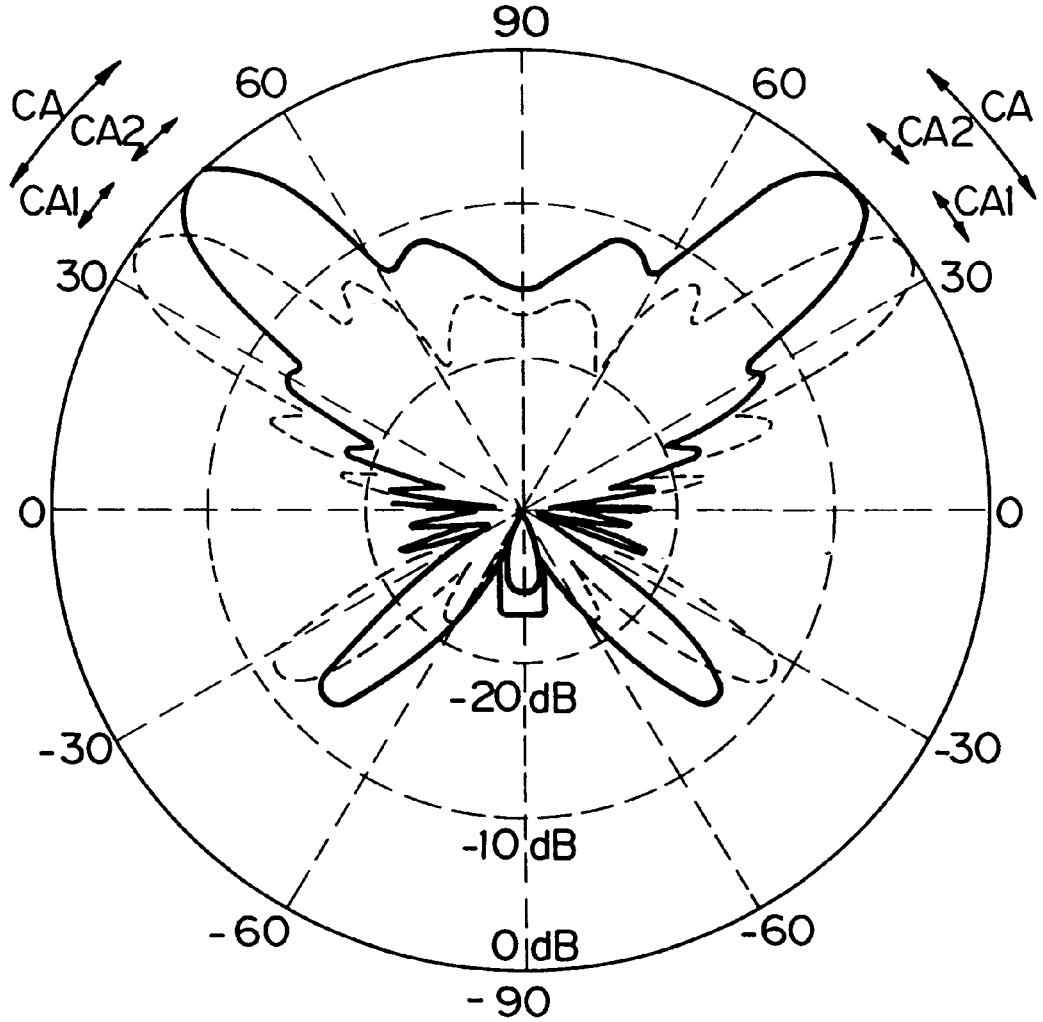
FIG. 15 is a radiation pattern generated by the helical antenna of FIG. 11.

In this case, when the number of turns is 10 by twisting the helical conductors 2 and 3, a coverage area CA1 defined by a radiation pattern indicated by a dotted line in FIG. 15 is obtained. Also, when the number of turns is 11 by twisting the helical conductors 2 and 3, a coverage area CA2 defined by a radiation pattern indicated by a solid line in FIG. 15 is obtained. Thus, a broad coverage area CA by combining the coverage areas CA1 and CA2 can be obtained.

In the above-mentioned embodiments, bifilar helical antennas are illustrated; however, the present invention can be applied to helical antennas other than the bifilar helical antennas, such as monofilar helical antennas.

As explained hereinbefore, according to the present invention, a broad elevation angle coverage area can be obtained.

We claim:

1. A helical antenna for producing a conical beam comprising:

at least one coaxial cable defining a cable length;

first and second helical conductors oppositely wound on said at least one coaxial cable, wherein each of said helical conductors comprises a plurality of turns positioned along said cable length with spaces between adjacent turns defining a pitch, a wound state of said helical conductors being non-uniform and non-logarithmic so that said pitch is varied along said cable length, said two helical conductors, when properly tuned and energized, providing a concurrent and direct generation of two oppositely polarized waves which are emitted by said antenna to travel in the same direction in a broad radiation pattern and with a broad elevation angle range.

2. A helical antenna as set forth in claim 1, wherein the size of a plurality of said spacings between adjacent turns of each of said helical conductors varies in accordance with the positions of said turns along said cable length.

3. A helical antenna as set forth in claim 2, wherein said spacing between adjacent turns varies gradually in accordance with the positions of said turns along said cable length.

4. A helical antenna as set forth in claim 2, wherein the size of said spacings between adjacent turns varies uniformly in accordance with the positions of said turns along said cable length.

5. A helical antenna as set forth in claim 2, wherein a helix diameter of each turn of said helical conductor varies along said cable length in accordance with the position of said turn along said cable length.

6. A helical antenna as set forth in claim 5, wherein the helix diameter varies gradually along said cable length in accordance with the positions of said turns along said cable length.

7. A helical antenna as set forth in claim 5, wherein the helix diameter varies uniformly in accordance with the positions of said turns along said cable length.

8. A helical antenna as set forth in claim 5, further comprising a plurality of dielectric supporting elements for fixing said helical conductor to said coaxial cable.

9. A helical antenna as set forth in claim 8, wherein the width of each of said helical conductors varies uniformly in accordance with the positions of said turns along said cable length.

10. A helical antenna as set forth in claim 8, wherein the width of each of said helical conductors varies nonuniformly in accordance with the positions of said turns along said cable length.

11. A helical antenna as set forth in claim 1, wherein a width of each of said helical conductors is changed in accordance with positions of turns of said helical conductor along said cable length.

12. A helical antenna as set forth in claim 11, wherein the width of each of said helical conductors is changed in accordance with a type of cable.

13. A helical antenna as set forth in claim 11, wherein a helix diameter of each turn of said helical conductors varies in accordance with the position of said turns along said cable length.

14. A helical antenna as set forth in claim 13, wherein the helix diameter is gradually changed in accordance with the positions of said turns along said cable length.

15. A helical antenna as set forth in claim 13, wherein the helix diameter varies uniformly in accordance with the positions of said turns along said cable length.

16. A helical antenna as set forth in claim 13, wherein the helix diameter varies in accordance with a type of cable.

17. A helical antenna comprising:

at least one coaxial cable defining a cable length;

first and second helical conductors oppositely wound on said at least one coaxial cable, wherein each of said helical conductors comprises a plurality of turns positioned along said cable length with spaces between adjacent turns defining a pitch, a wound state of said helical conductors being non-uniform so that said pitch is varied along said cable length, said two helical conductors, when properly tuned and energized, providing a concurrent and direct generation of two oppositely polarized waves which are emitted by said antenna to travel in the same direction in a broad radiation pattern and with a broad elevation angle range, wherein the size of a plurality of said spacings between adjacent turns of said helical conductor varies in accordance with the positions of said turns along said cable length, and, wherein said at least one cable comprises two different types of coaxial cable and the size of said spacings between adjacent turns varies in accordance with the types of said coaxial cable, said types varying on the basis of their lengths.

18. A helical antenna comprising:

at least one coaxial cable defining a cable length;

first and second helical conductors oppositely wound on said at least one coaxial cable, wherein each of said helical conductors comprises a plurality of turns positioned along said cable length with spaces between adjacent turns defining a pitch, a wound state of said helical conductors being non-uniform so that said pitch is varied along said cable length, said two helical conductors, when properly tuned and energized, providing a concurrent and direct generation of two oppositely polarized waves which are emitted by said antenna to travel in the same direction in a broad radiation pattern and with a broad elevation angle range, wherein a helix diameter of each turn of said helical conductor varies along said cable length in accordance with the position of said turn along said cable length, and wherein said at least one cable comprises two different types of coaxial cable and the helix diameter varies along said cable length in accordance with the types of said coaxial cable, said types varying on the basis of their lengths.

19. A helical antenna comprising:

at least one coaxial cable defining a cable length;

first and second helical conductors oppositely wound on said at least one coaxial cable, wherein each of said helical conductors comprises a plurality of turns positioned along said cable length with spaces between adjacent turns defining a pitch, a wound state of said helical conductors being non-uniform so that said pitch is varied along said cable length, said two helical conductors, when properly tuned and energized, providing a concurrent and direct generation of two oppositely polarized waves which are emitted by said antenna to travel in the same direction in a broad radiation pattern and with a broad elevation angle range, said at least one coaxial cable further comprising a plurality of coaxial cables having different lengths and being connected parallely along one axis, said helical conductors being wound thereon, said plurality of cables comprising different types varying on the basis of their lengths.

20. A helical antenna as set forth in claim 19, further comprising a plurality of input/output connectors, each being connected to one of said coaxial cables.

21. A helical antenna as set forth in claim 19, wherein spacings between turns of said helical conductors are changed in accordance with the types of said coaxial cables.

22. A helical antenna as set forth in claim 19, wherein a helix diameter of each turn of said helical conductors is changed in accordance with said coaxial cables.

23. A helical antenna as set forth in claim 19, wherein a width of each of said helical conductors is changed in accordance with said coaxial cables.

24. A helical antenna as set forth in claim 19, further comprising at least one metal plate interposed between said helical conductors.

25. A helical antenna as set forth in claim 19, further comprising at least one radio wave absorption plate interposed between said helical conductors.

26. A helical antenna as set forth in claim 19, further comprising a plurality of dielectric supporting elements for fixing said helical conductor to said coaxial cables.

27. A helical antenna comprising:

a dielectric cylinder having a longitudinal axis;

at least two oppositely wound helical conductors mounted within said dielectric cylinder and extending along said axis;

a coaxial cable, for substantially all of its length along said axis of said dielectric mounted outside of said dielectric cylinder and connected to said helical conductors, said cable being disposed substantially parallel to said axis; and twisting means, mounted on said dielectric cylinder, for twisting said helical conductors;

said two helical conductors, when properly tuned and energized, providing a concurrent and direct generation of two oppositely polarized waves which are emitted by said antenna to travel in the same direction.

28. A helical antenna as set forth in claim 27, wherein said twisting means comprises:

a first cap fixed at a first end of said dielectric cylinder and connected to a first end of at least one of said helical conductors;

a second cap rotatably mounted at a second end of said dielectric cylinder and connected to a second end of at least one of helical conductors.

29. A helical antenna as set forth in claim 28, wherein said second cap has at least one hole for receiving at least one of said helical conductors.

30. A helical antenna comprising;

a dielectric cylinder;

at least one helical conductor mounted within said dielectric cylinder;

a coaxial cable, mounted outside of said dielectric cylinder and connected to said helical conductor;

twisting means, mounted on said dielectric cylinder, for twisting said helical conductor;

a first cap fixed at a first end of said dielectric cylinder and connected to a first end of said helical conductor; and a second cap rotatably mounted at a second end of said dielectric cylinder and connected to a second end of said helical conductor;

wherein said second cap has a plurality of protrusions corresponding to a plurality of holes provided at an innerwall of said dielectric cylinder.

31. A helical antenna comprising;

a dielectric cylinder;

at least one helical conductor mounted within said dielectric cylinder;

a coaxial cable, mounted outside of said dielectric cylinder and connected to said helical conductor; and twisting means, mounted on said dielectric cylinder, for twisting said helical conductor;

a first cap fixed at a first end of said dielectric cylinder and connected to a first end of said helical conductor; and a second cap rotatably mounted at a second end of said dielectric cylinder and connected to a second end of said helical conductor;

wherein said second cap has a plurality of holes corresponding to a plurality of holes provided at the second end of said dielectric cylinder, said second cap being fixed to said dielectric cylinder by inserting a pin into one of said holes of said second cap and one of said holes of said dielectric cylinder.

* * * * *